US010543712B2

(12) United States Patent
Behm et al.

(10) Patent No.: US 10,543,712 B2
(45) Date of Patent: Jan. 28, 2020

(54) METHODS FOR SECURING VARIABLE INDICIA ON INSTANT (SCRATCH-OFF) TICKETS

(75) Inventors: William F. Behm, Roswell, GA (US); Kenneth Earl Irwin, Jr., Dawsonville, GA (US)

(73) Assignee: Scientific Games International, Inc., Newark, DE (US)

( * ) Notice: Subject to any disclaimer, the term of this patent is extended or adjusted under 35 U.S.C. 154(b) by 292 days.

(21) Appl. No.: 13/092,263

(22) Filed: Apr. 22, 2011

(65) Prior Publication Data

US 2012/0267888 A1 Oct. 25, 2012

(51) Int. Cl.
*B42D 25/27* (2014.01)
*B42D 25/378* (2014.01)
*B42D 25/373* (2014.01)

(52) U.S. Cl.
CPC ..... *B42D 25/378* (2014.10); *B42D 25/27* (2014.10); *B42D 25/373* (2014.10)

(58) Field of Classification Search
CPC ..... B42D 25/27
USPC ..... 283/102, 903
See application file for complete search history.

(56) References Cited

U.S. PATENT DOCUMENTS 4,241,942 A * 12/1980 Bachman ..... 283/903
5,310,778 A * 5/1994 Shor et al. ..... 524/556
5,679,138 A * 10/1997 Bishop et al. ..... 106/31.75
5,769,458 A * 6/1998 Carides et al. ..... 283/903
5,863,075 A 1/1999 Rich et al.
7,252,222 B2 8/2007 Finnerty et al.
7,364,091 B2 4/2008 Streeter
7,562,626 B2 * 7/2009 Morizumi et al. ..... 283/903
7,837,117 B2 11/2010 Finnerty et al.
2007/0197684 A1 * 8/2007 Yamashita et al. ..... 523/160
2009/0108578 A1 * 4/2009 Commander ..... 283/72
2009/0166968 A1 7/2009 Stephens et al.
2009/0263583 A1 10/2009 Mantell et al.
2010/0218693 A1 * 9/2010 Kozdras ..... 283/903

FOREIGN PATENT DOCUMENTS

EP 0 568 814 A2 11/1993
EP 0 761 441 A2 3/1997
KR 2010 0084489 7/2010
WO WO 2008/027400 A2 3/2008

OTHER PUBLICATIONS

PCT Search Report, dated Jan. 4, 2013.

* cited by examiner

*Primary Examiner* — Kyle R Grabowski
(74) *Attorney, Agent, or Firm* — Dority & Manning, P.A.

(57) ABSTRACT

A security-enhanced document, such as an instant lottery ticket, includes a substrate. Indicia is provided on the substrate, and a scratch-off-coating (SOC) layer is applied over the indicia to maintain the indicia unreadable until removal of the SOC layer. The indicia is printed onto the substrate as pigmented particles. One or more opacity film layers may be provided over or under the pigmented particle indicia.

8 Claims, 11 Drawing Sheets

METHODS FOR SECURING VARIABLE INDICIA ON INSTANT (SCRATCH-OFF) TICKETS

FIELD OF THE INVENTION

The present invention relates generally to documents, such as lottery tickets, having indicia under a scratch-off-coating (SOC), and more particularly to methods for enhancing the security of the documents without detracting from the aesthetics of the documents.

BACKGROUND

Lottery scratch-off or instant games have become a time-honored method of raising revenue for state and federal governments the world over. Indeed, the concept of hiding indicia information under a Scratch-Off-Coating (SOC) has also been applied to numerous other products such as commercial contests, telephone card account numbers, gift cards, etc. Literally, billions of scratch-off products are printed every year where the Scratch-Off-Coatings (SOCs) are used to ensure that the product has not been previously used, played, or modified. Typically the indicia are printed using a high speed ink jet printing process, which uses a dye base, water soluble ink system. Thus, ensuring that the printed indicia cannot be read or decoded without first removing the SOC is paramount to ensure that a game or product is secure.

Unfortunately, there are known techniques (e.g., wicking, vapor, steam, etc.) that can be used to diffuse the variable, water soluble, ink jet indicia through the substrate backing or the front SOC. When utilized successfully, these techniques can allow an observer to temporally determine if a given ticket is a winner or non-winner leaving little or no trace of the security breach. Therefore, these diffusion techniques could allow a retailer to identify all winning tickets in a pack, only selling the losing tickets to an unsuspecting public.

In addition to diffusion techniques, electrostatic charges can be applied to an instant ticket with an intact SOC, which under some circumstances creates a differential charge in the hidden ink jet indicia. If an indicia differential charge is achieved, fine powder aspirated over the SOC will align with the hidden indicia allowing for the indicia to be read over an intact SOC, again allowing winning tickets to be identified. When the charge is removed and the powder brushed away, no indication remains that the ticket's integrity was compromised.

Finally, there are techniques for inducing fluorescence in the ink jet indicia dye on the tickets in the infrared (IR) wavelength range that under some circumstances can be detected through an intact SOC with IR sensitive devices (e.g., infrared night vision goggles), yet again allowing winning tickets to be identified without leaving a trace.

Of course, all of the above indicia compromise techniques have associated security countermeasures that have been painstakingly developed over the years to reduce or eliminate errant detection of unplayed winning tickets or documents secured by a SOC. Typically, these security countermeasures involve adding blocking layers of inks that effectively seal the indicia in a protective cocoon. However, these blocking layers are susceptible to intermittent failures, especially when the blocking layers are applied with too thin or with an erratic deposit on the substrate. Additionally, the added blocking layers of security ink(s) require large and expensive printing presses, with typically an additional press printing station required to print each added ink security layer. Indeed, in some embodiments, these added ink security layers could total four or five additional ink film applications, resulting in a significant increase in printing complexity and costs. Furthermore, these added security layers tend to dull the appearance of the printed product, thereby reducing its marketability.

On a conceptual level it can be seen that all of these techniques for security compromises are a direct result of the ink jet indicia being comprised of a printing dye rather than a traditional ink—a printing dye being an entirely liquid medium that stains or colors the substrate and coatings to which it is applied as opposed to an ink that carries solid pigments that are deposited on the substrate and coatings. Thus, the term 'ink jet' is somewhat of a misnomer, with 'dye jet' being a more accurate (albeit not commonly used) description. The reason that indicia embodied as dye fosters security problems, is that the dye staining its substrate is inherently susceptible to chemical attacks that re-liquefy it thereby allowing for dye migration or diffusion. Furthermore, the long molecular chains of Volatile Organic Compound (VOC) dyes (typical of traditional variable ink jet indicia systems) can be more susceptible to fluorescence especially after the dye has dried on a substrate. Printing inks, on the other hand, are liquids that suspend solid pigmented particles in a liquid medium. With pigmented inks the color and definition is achieved by the pigment residue that resides on the substrate after the liquid carrier is evaporated or altered to a solid state. This solid pigmented ink film residue is inherently resistant to migration attacks, since the solid particles tend to stay put after being applied and cured. Furthermore, the use of pigment particles can potentially reduce the differences in electrostatic charges as well as fluorescence.

In addition to dye based retailer pick-out security problems in the variable indicia discussed above, the relatively low resolution (e.g., 120 or 240 dots per inch—'dpi') of existing variable indicia in lottery tickets and other SOC secured documents have allowed additional security vulnerabilities to persist in both consumer fraud and retailer pick-out.

Recently, barcodes permitting automatic ticket validation have been printed under the SOC, with the concept being to allow for automated ticket redemption by reading the barcode (as disclosed in U.S. Pat. No. 6,308,991) that would only appear after the SOC was removed. Typically, these validation barcodes are of a two-dimensional format to compensate for debris left on the validation barcode after partial removal of the SOC. However, these relatively large two-dimensional barcodes introduce new security problems. For example, the large space and redundant nature of two-dimensional barcodes allow for a small portion of the barcode to be exposed to supply sufficient information to determine if a ticket is a winner. While this attribute is desirable for automated validation purposes, the higher contrast requirements of two-dimensional barcode scanning sometimes requires for lower opacity layer(s) to be omitted in the area of the barcode. These omissions of security layers can make the barcode susceptible to candling and diffusion attacks.

Consumer fraud is a different matter, in consumer fraud the security vulnerability is a direct result of the lower resolution indicia requiring a high contrast with their background to be identified on sight. In other words, lower resolution variable indicia require a higher contrast background that typically results in the indicia being printed as isolated islands with no background graphics. This in turn, results in a susceptibility to a consumer cutting indicia out of losing lottery tickets and pasting the cutout indicia together to create an apparent fraudulent winning ticket composite. To complete this scenario, the boxed digit and/or SOC validation barcode areas are also destroyed by excessive scratching such that the ticket will no longer validate through a central site system—i.e., the boxed digit or validation barcode is destroyed such that a central site validation system would have insufficient information to authenticate the composite ticket. Thus, an apparent winning ticket from a visual inspection could be accepted for fraudulent payment by a retailer for its fabricated face value. In the past, varying Benday patterns have been display printed (e.g., flexographic, offset, etc.) in the ticket's scratch-off background as a countermeasure to this aforementioned cut and paste attack. However, since the Benday patterns are display printed, they repeat thereby only hampering and not eliminating the cut and paste attack. Additionally, Carides et al. (U.S. Pat. No. 5,769,458) discloses variable Benday patterns, as well as Rich et al. (U.S. Pat. No. 5,863,075). However, both patents address variable Benday patterns with hidden messages. Additionally, the Benday patterns tend to detract from the appearance and marketability of the ticket/document as well as reducing the contrast and readability of the low-resolution variable indicia.

Therefore, it is desirable to develop methodologies for ensuring the integrity of tickets/documents with SOC protected indicia by incorporating pigmented variable indicia (i.e., true 'ink jet') rather than traditional dye based variable indicia. Additionally, these developed methodologies should also incorporate higher resolution variable indicia imaging and possibly new (e.g., nano-pigmented) as well as fewer security ink coatings.

SUMMARY

Objects and advantages of the invention will be set forth in part in the following description, or may be obvious from the description, or may be learned through practice of the invention.

In accordance with aspects of the invention, a security-enhanced document is provided, which may be an instant lottery ticket in certain embodiments. The document includes any manner of suitable substrate, with indicia printed on the substrate. A Scratch-Off-Coating (SOC) layer is applied over the indicia to maintain the indicia unreadable until removal of the SOC layer. The indicia comprise pigmented particles applied to the substrate in a printing process.

In a particular embodiment, the pigmented particle indicia are applied directly onto the substrate without an intervening layer. With this embodiment, at least one opacity ink film layer may be applied over the pigmented particle indicia. This opacity ink film layer may be, for example, a nano-particle-sized pigment film having pigment particles between 1 and 100 nanometers. This layer may further be a metal-based film layer with metal nanoparticle-sized pigment particles. It may be desired in certain embodiments to provide a white pigment source applied over the opacity ink film layer.

In other embodiments, at least one opacity ink film layer is applied on the substrate below the pigmented particle indicia. This opacity ink film layer may comprise a nano-particle-sized pigment film having pigment particles between 1 and 100 nanometers. The pigmented particle indicia may be non-metallic and be comprised primarily of pigment particles having a size less than 150 nanometers.

The purposes of the pigmented particle indicia on the substrate may vary. For example, the indicia may define a security barcode in certain embodiments. In embodiments the indicia may be play indicia that indicates the outcome of the game.

The pigmented particle indicia may have an enhanced resolution in certain embodiments, for example a resolution of at least 500 dpi. This enhanced resolution indicia may be provided with a complex background that is also covered by the SOC layer, with the background varying between at least one of color or pattern throughout the SOC layer area. The varying background may blend with indicia or graphics on the document outside of the SOC layer area.

The invention also encompasses a security-enhanced document defined by a substrate having any manner of indicia provided thereon. A SOC layer is applied over the indicia to maintain the indicia unreadable until removal of the SOC layer. One or more security layers are provided under the SOC layer and are made up substantially of nano sized particles between 1 to 100 nm, wherein the security layers are applied in a printing process.

In still other aspects, the invention encompasses a security-enhanced document defined by a substrate having any manner of indicia provided thereon. A SOC layer is applied over the indicia to maintain the indicia unreadable until removal of the SOC layer. The indicia is applied to the substrate with a resolution at least at 500 dpi, and is printed sufficiently complex to preserve entropy against pin prick attacks while retaining or enhancing clarity of documents properly played by removal of the SOC layer.

The invention is not limited to a particular type of document, although the invention is particularly applicable to instant lottery tickets.

DETAILED DESCRIPTION

Figure 1:
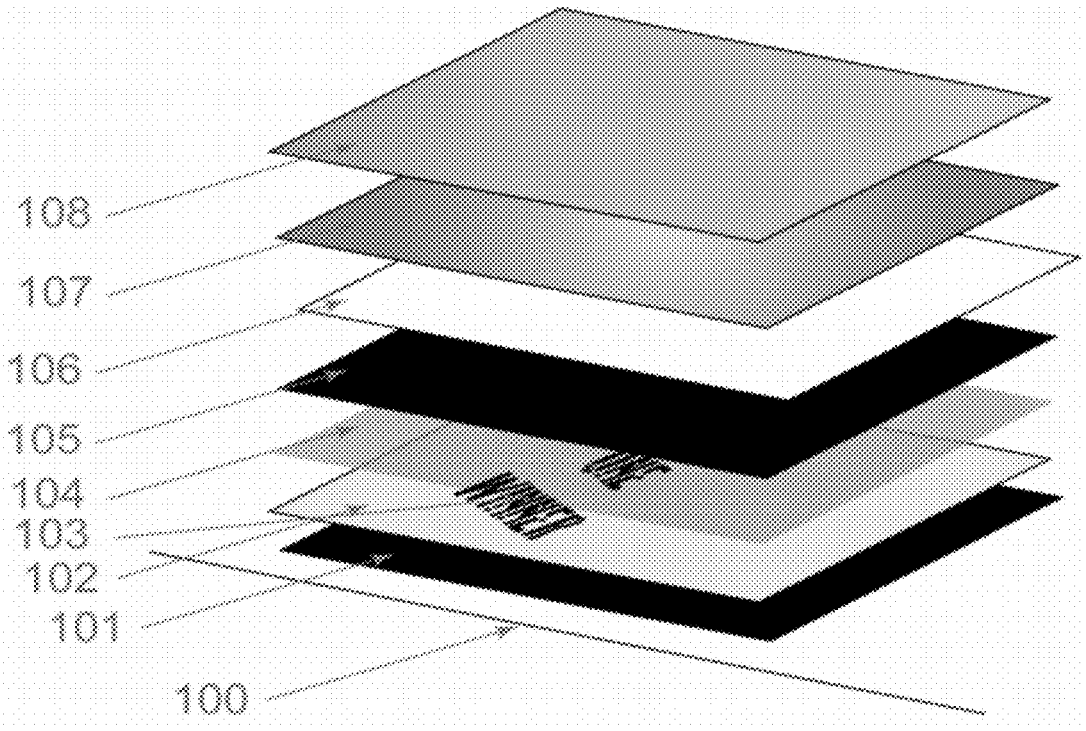
FIG. 1 is a front plan view of a representative example of a traditional (i.e., ink jet dye/low resolution) lottery-type instant ticket security ink film stack.

Reference will now be made in detail to examples of the invention, one or more embodiments of which are illustrated in the drawings. Each example is provided by way of explanation of the invention, and not meant as a limitation of the invention. For example, features illustrated or described as part of one embodiment, may be used with another embodiment to yield still a further embodiment. It is intended that the present invention encompass these and other modifications and variations as come within the scope and spirit of the invention.

FIG. 1 depicts a representative example of the variable indicia and associated security ink stack typical of traditional ink jet dye, low resolution, Scratch-Off-Coating (SOC) secured documents—e.g., instant lottery tickets. As shown in FIG. 1, the variable dye printed indicia 103 is sandwiched between lower (101 and 102) and upper (104 thru 108) security ink films in an attempt to isolate the variable indicia 103 from wicking (diffusion), candling, electrostatic, fluorescence, and other know attacks. The entire ink film stack is deposited on a paper, foil, or other substrate 100. The lower security ink film layers providing opacity 101 and wicking barriers as well as a higher contrast (e.g., white or gray) background 102 so that the low-resolution (e.g., 240 dpi) variable indicia 103 can be readily identified by a consumer. The upper security ink film layers also isolate the variable indicia 103, first with a release coating 104 that helps seal the indicia to the substrate and also causes any ink films printed on top of it to scratch off. Next, one or more upper opacity layer(s) 105 is applied to help protect against electrostatic, candling, and fluorescence attacks. On top of the opacity layer(s) one or more white or gray ink film(s) 106 is typically applied that provides a higher contrast background for overprint inks. Finally, decorative overprint inks 107 and 108 are applied for both an attractive appearance of the SOC area as well as sometimes providing additional security against wicking, mechanical lifts, and other attacks. Thus, a large number of security ink film layers (seven in the example of FIG. 1) are required to protect and allow for consumer readability of the variable indicia 103 of a traditional, low resolution, SOC protected document such as an instant lottery ticket. Of course, the example of FIG. 1 is just one possible arrangement of a traditional SOC protected document security ink films, with the goal of any security ink film coating arrangement being to encapsulate the variable indicia in a protective cocoon.

Figure 2:
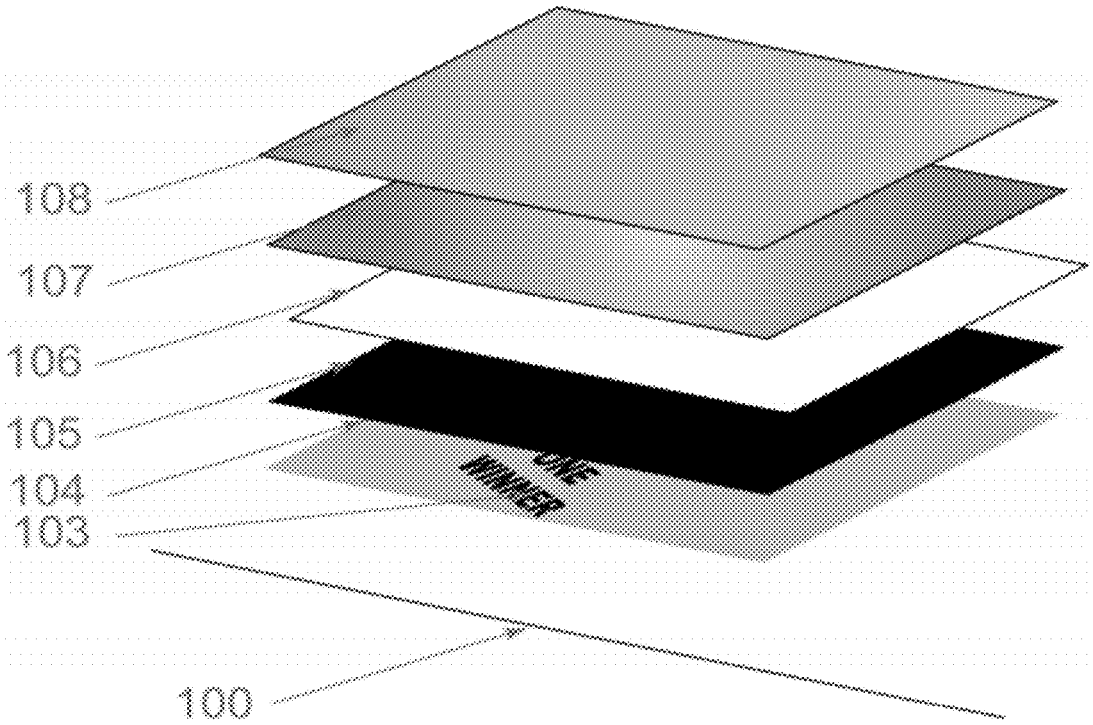
FIG. 2 is a front plan view of a first representative example of a modified lottery-type instant ticket security ink film stack utilizing pigmented variable indicia.

In contrast, FIG. 2 provides a front plan view of a first representative example of a SOC protected document security ink film stack covering ink jet pigmented variable indicia. As is readily apparent, the example of FIG. 2 omits the lower security layers (101 and 102) of the traditional dye ink jet variable indicia SOC protected document. This is possible because the variable ink jet indicia 103 of FIG. 2 utilize pigmented particles that are inherently resistant to diffusion or wicking attacks since the solid pigmented particles tend to stay in place once cured. Additionally, the long molecular chains of Volatile Organic Compound (VOC) dyes (typical of dye indicia systems) that tend to be susceptible to fluorescence are absent from pigmented indicia. With these inherent resistances of pigmented indicia, the need for lower blocking layers 101 and 102 of FIG. 1 to guard against diffusion or wicking attacks is eliminated. Thus, if sufficient opacity can be achieved in the upper blocking layer(s) 105 to guard against candling and any presently unknown fluorescence attacks, the pigmented variable indicia 103 can be applied directly to the SOC protected document's substrate 100 without any compromise in security. Of course, if achieving sufficient opacity in the upper blocking layer(s) 105 becomes problematic or a printing press configuration more readily accommodates additional lower security layers than upper, one or more lower opacity security ink film layer(s) can be added with the pigmented indicia similar to the dye based variable indicia. However, since pigmented base variable indicia are inherently resistant to diffusion/wicking attacks, the lower blocking layer need only concern itself with opacity security. Thus, the chemistry of any lower blocking layer is simplified, allowing for a greater variety and, optionally, the use of a non-black ink film opacity layer application.

One possible new type of opacity layer that, ironically is also compatible with dye based variable indicia, is an opacity ink film based on nanoparticle-sized pigments. The term 'nanoparticles' generally refers to extremely small particles that are typically sized between 1 and 100 nanometers. The extremely small size of nanoparticles can cause inks made with nano-sized pigments to exhibit size-related properties that differ significantly from those observed in traditionally sized fine pigment particles of the same material. For example with traditional particle sized inks, greater opacity is typically achieved with the use of larger particle sizes, with the larger particles creating fewer holes for light to pass through. However, with nano-sized ink particles, the extremely small size of nano particles create leafing effects as well as any remaining holes between the nano particles being smaller than the wavelength of visible light (e.g., <350 nm) thereby creating greater opacity. In other words, a bulk pigment material will have constant physical properties regardless of its size, but at the nano-scale, size dependent properties of pigments are often observed. The interesting and sometimes unexpected properties of nanoparticles are therefore largely due to the large surface area of the material, which dominates the observed characteristics when compared to the small bulk of the material.

When employing nanoparticles in SOC secured documents, the large surface area of nano particles tends to create inks that are ideally suited for providing opacity. The extremely small size, surface area, and leafing (i.e., overlaying) characteristics of nanoparticle based inks allow the pigments to effectively plug microscopic holes in the homogeneous particle dispersion thereby blocking any light path through the smallest of orifices. When nanoparticle based metal pigments (e.g., aluminum, silver, etc.) are employed for optical blocking, the light blocking characteristics of metal allow the particles to stop light transfer, while at the same time not providing as dark (and consequently low contrast) background as more traditional carbon based pigmented inks with a much larger particle size. If nanoparticle-sized pigments are coated or covered with a white pigment source (e.g., titanium dioxide) in a secondary process, the opacity layer can appear white or light gray to an observer, creating a high contrast background as well as a suitable pallet for process color indicia. Additionally, since the surface area and leafing of nanoparticle sized pigments are much larger, greater levels of opacity can be achieved with thinner ink film applications (e.g., 2.0 to 3.84 BCM—Billion Cubic Microns), with the reduced material in thinner ink films being a desirable characteristic unto itself—i.e., scratch-off coatings tend to be cleaner. Despite the thinner applications, the large surface areas of nano particles often require additional drying in comparison to standard particle sized inks. This enhanced drying can most readily be achieved with the use of Infrared (IR) driers in addition to hot air driers.

Of course, there are other characteristics inherent in nanoparticle-sized pigments that are desirable for SOC protected variable indicia documents. For example, the same extremely large surface area and associated leafing effects of nanoparticle-sized metal pigments coupled with their reflectivity make them ideal for printing a light reflecting ink film. This light reflecting ink film can be used as an upper security opacity layer, at the same time providing marketing appeal with a shiny surface. Indeed, pottery from the Middle Ages and Renaissance often retains a distinct gold or copper colored metallic glitter to this very day. This so called luster was caused by a metallic film that was applied to the transparent surface of a glazing. The luster originated within the film itself, which contained silver and copper nanoparticles dispersed homogeneously in the ceramic glaze. These nanoparticles were created by the unaware artisans of antiquity by adding copper and silver salts and oxides together with vinegar, ochre, and clay on the surface of previously glazed pottery. However, when printing nano particles with modern printing presses it has been found that smoother and more solid ink film applications (and hence more reflective and opaque) can be achieved, under some circumstances, with two applications of the nano based pigmented ink using screened (tinted) printing plates rotated at acute angles relative to each other.

Figure 3:
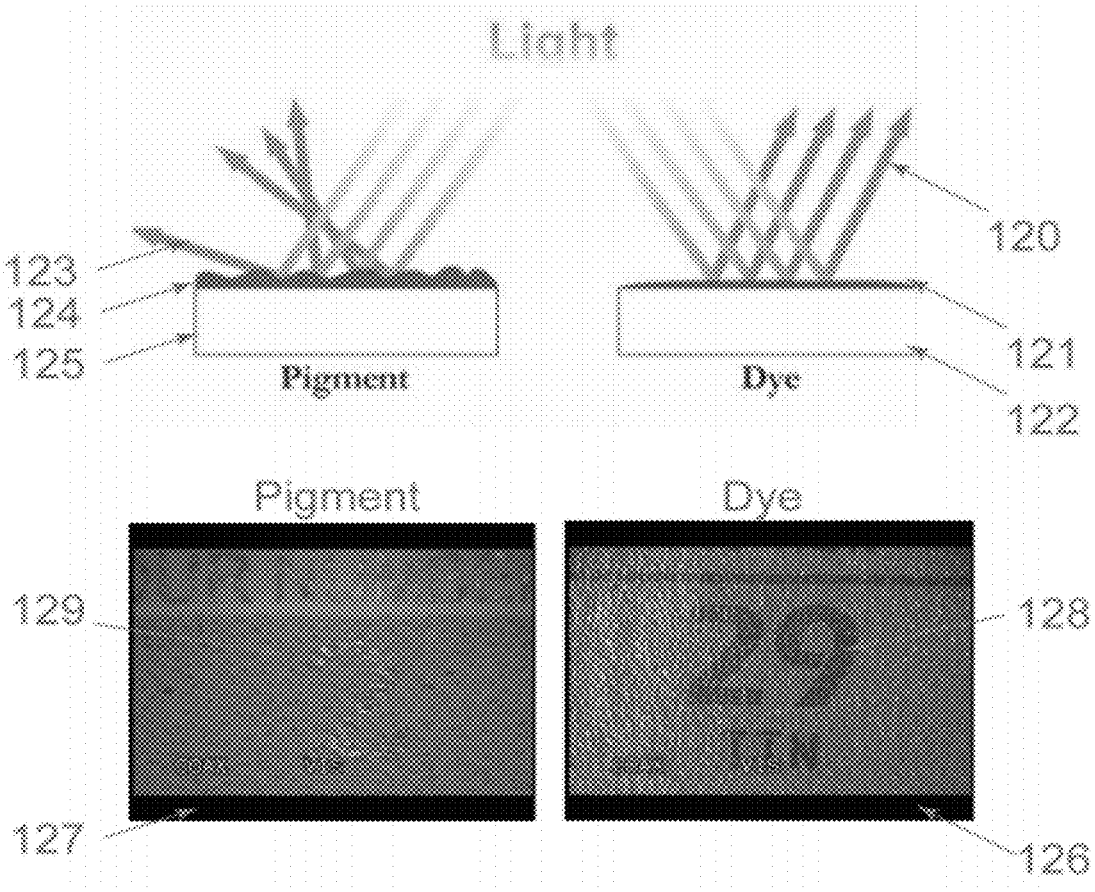
FIG. 3 is a side view of a representative example illustrating the differences in light dispersion between dye based and pigment based Indicia as well as top photographs demonstrating the differences between dye based and pigment based indicia when viewed under coaxial

Returning to the pigmented based variable indicia 103 of FIG. 2, aside from the inherent resistance to diffusion/wicking and known fluorescence attacks of pigmented based variable indicia 103, the use of pigmented particles also significantly alters the interaction between visible light and the variable indicia. FIG. 3 provides an illustration of the differences between light scatter with dye based and pigmented variable indicia. In FIG. 3 light rays 120 are shown to reflect off the dye based indicia residue 121 in a uniform matter. Of course, this uniformity of reflection off dye based indicia residue is also related to the nature of the substrate 122 to which the dye 121 is applied. However, as a general rule, with relatively smooth substrates 122 typical of the printing industry, the light reflection off of the dye based indicia residue 121 will be uniform as shown in FIG. 3. In contrast, pigmented based indicia 124, by its very nature tends to scatter light 123 reflected off of the pigmented based indicia 124. This light scattering 123 is due to the fact that pigmented particles that are greater than nano sized will inevitably be deposited on any substrate 125 in an irregular and non-smooth manner due to the entropy of particle dispersion.

These differences in light dispersion can create differences in the ability to identify indicia under an intact SOC using fluorescence (i.e., where a bright monochromatic light source at the excitation wavelength of the indicia dye/pigment is used to induce fluorescence in a different (typically longer) wavelength of light. Since the fluorescence emission is in a different wavelength of light, the bright excitation light source can be completely filtered out allowing for detection of very small amounts of fluorescence). With the pigmented base variable indicia 124 providing greater immunity to fluorescence attacks due to the scattering of light 123 reflected off its pigmented particles 124. The dye based variable indicia 121 however, tends to reflect and absorb light uniformly 120. This uniform nature 120 allows for easier identification of the dye based variable indicia 121 when inducing fluorescence in a SOC secured document—i.e., the smooth and uniform surface of the dye indicia creating a more efficient plane to receive excitation light as well as transmit fluorescence emissions.

The disparity in light reflection is illustrated by the two photographs in FIG. 3 of dye 126 and pigmented 127 based indicia illuminated by coaxial light—i.e., illumination light is routed to a point very near the viewing axis and is projected down through the same lens used for viewing. In FIG. 3 the contrast between the dye 128 and pigmented 129 indicia samples is notable. In the figure, the irregularities of the pigmented indicia 129, accentuated with the coaxial illumination, produce an image with low contrast; almost appearing as a slightly reflective portion of the substrate. Again, this is due to the irregular scattering of light 123 off the pigmented indicia 124 that is accentuated by the coaxial illumination. However, when the dye based indicia 128 are illuminated with the same coaxial light source, the dye-based indicia 128 retain a relatively higher contrast ratio. The relative uniformity of reflection 120 and 128 of dye-based indicia creating sharper definition when viewed under coaxial illumination. While the special illumination of FIG. 3 does not exist when viewing a properly played scratch-off ticket, the coaxial illumination does give an indication of how the two types of indicia (i.e., dye/pigmented) will appear when viewed though small pinholes—either due to an inadequate blocking layer application or intentionally created with a needle. Thus, the natural scattering effect of the pigmented indicia offering more entropy (and hence security) then its dye counterpart when viewed through the very small orifices typical of pin holes.

While some advantages are to be gained with pigmented indicia, care should nevertheless be exercised to ensure that pigmented indicia implementation does not create new security problems. For the most part, avoidance of new security problems can be achieved with careful selection of the particle size and material used in the pigmented indicia. For example, toner based pigmented indicia processes with large bulk material deposits of significant pigment size; tend to leave thick pigment deposits, which consequentially are easily detected under an intact SOC with glancing illumination. In other words, simply holding some toner based pigmented indicia at obtuse angles between an illumination source and viewer can, under some circumstances, allow for the indicia to be deduced with SOC overlays intact. Additionally, by the very nature of pigmented indicia, there is inherently more susceptibility to detection by X-ray and ultrasound scanners. Whereas dye based indicia, staining the surface it is applied to, tends to have immunity to obtuse viewing as well as X-ray and ultrasound scanning. However, careful selection of pigment materials (e.g., typical ink jet coloring pigments as opposed to toner based pigments), while ensuring small pigment particle sizes (e.g., <150 nm), while regulating the amount of pigment deposited as an indicia tends to mitigate obtuse viewing pick-out as well as X-ray and ultrasound potential security problems. Thus, it should be understood that unless otherwise noted, the term 'pigmented variable indicia' should be understood to be a shorthand for 'ink jet applied pigmented variable indicia' in this patent. The ink jet application ensuring that raw materials of the appropriate pigment size and substrate deposit amounts are applied to provide low profiles to obtuse viewing, X-ray, and ultrasound pick-out security problems.

Returning to the benefits, pigmented variable indicia also exhibit substantially less bleed in the printing process than traditional dye based variable indicia. In printing and graphic arts, the term 'bleeding' refers to an ink droplet or deposit diffusing to cover a larger area of the substrate than its original size. The amount of bleeding is affected by numerous factors, including the substrate type, ink type and properties (e.g., speed of ink drying), and printing technology (e.g., nozzle design and spacing with ink jet printers). Unless it is done for effect, bleeding reduces printing quality, particularly sharpness. Indeed, when barcodes are printed by a dye based ink jet product, the actual applied printed widths of the bars and spaces can be as much as 50% smaller than the desired width. In many barcode formats (e.g., Interleave Two of Five—'I-2of5'), the distinction between bar widths is critical and essential to encode information. When validation barcodes are printed in the scratch-off area under the SOC, it is critical to anticipate the correct amount of bleed in advance. However, due to the lower security coatings (e.g., 101 and 102 of FIG. 1), traditional dye based validation barcode bleed (which is printed on top of the security coatings) can vary substantially. When printing two-dimensional barcodes (e.g., Datamatrix) the problem of dye based validation barcode bleed is compounded. Due to the more complex shapes and designs of two-dimensional barcodes, the tolerance for bleed adjustment is much tighter as is the concern for bleed in two dimensions. Fortunately, validation barcodes printed with pigmented ink jet exhibit substantially less bleed. Moreover, any bleed in pigmented validation barcodes tends to be more consistent from substrate to substrate, making it possible to encode smaller validation barcodes under the SOC that also decode more easily. The inherent advantages of pigmented based variable indicia in SOC protected documents has remained unknown in the art, principally because printing variable indicia with pigmented particles involves forcing solid particles through relatively small orifices at high pressure. This process in turn tended to create excessive wear on the ink jet print heads and was therefore not viewed as practical. Recently, Kodak introduced its PROSPER S10 Imprinting System, which has been found suitable to produce variable pigmented indicia in either monochromatic or process colors.

In addition to pigmented variable indicia, SOC protected documents can also enjoy a significant improvement by increasing the indicia printing resolution to a higher value (e.g., 600 dpi) and/or adding color. Increasing the printing resolution of variable indicia has the obvious advantage of increased clarity and contrast making it far easier to identify particular indicia once the SOC is removed. At the same time, higher resolution imaging allows for more complex indicia designs that can, paradoxically, increase security against pin pricking while at the same time be more readily identifiable to people of poor eyesight when the SOC is removed and the ticket is properly played. These two seemingly diametrically opposed features can be achieved at the same time with careful attention to how information is conveyed. With low resolution imaging the simple cartoon like outlines of the indicia allow for small holes to be punched through the protective SOC with a pin or hypodermic needle that can allow an observer to deduce if the small portion of the indicia revealed is a winning icon or not.

Figure 4:
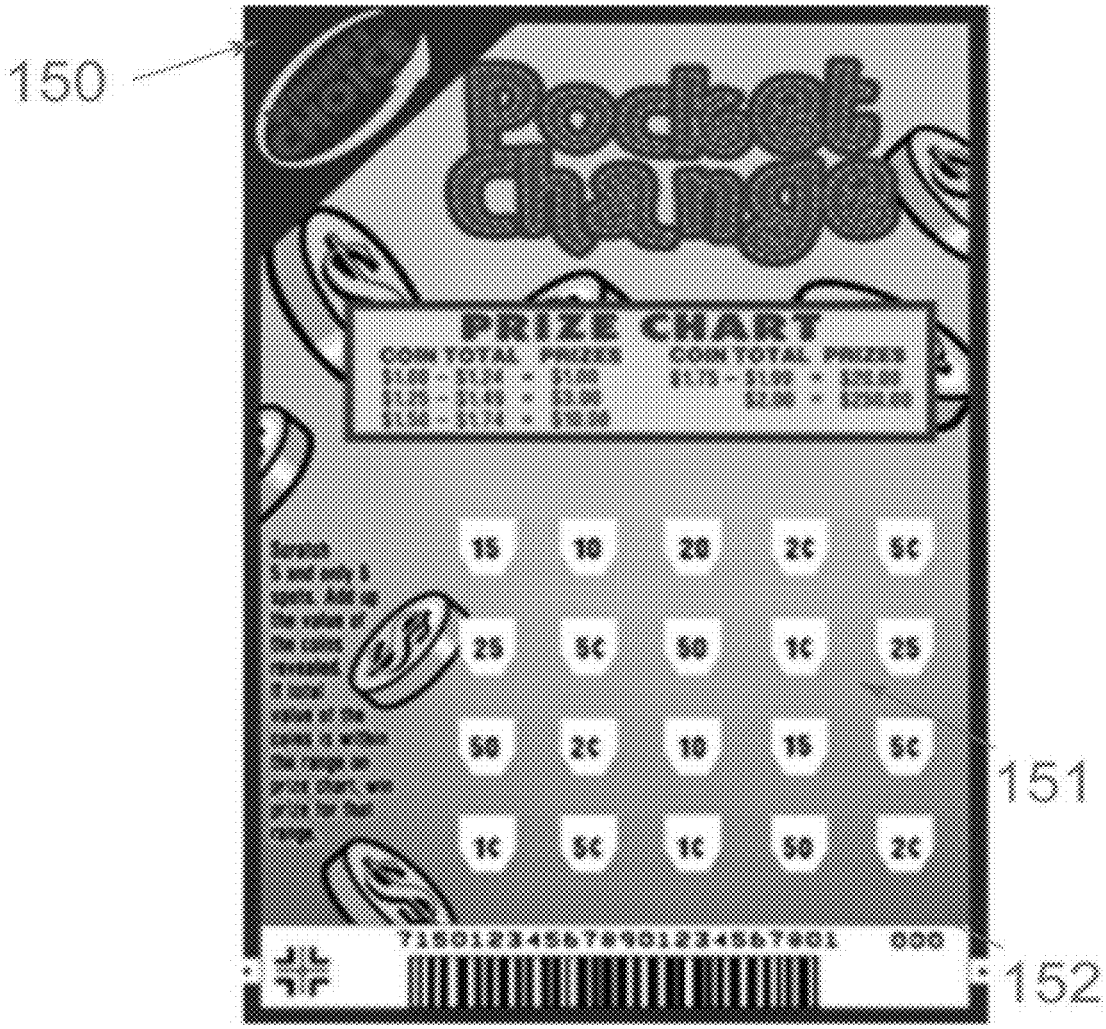
FIG. 4 is a front plan view of a first representative example of a lottery-type instant ticket susceptible to pinprick attacks.
Figure 5:
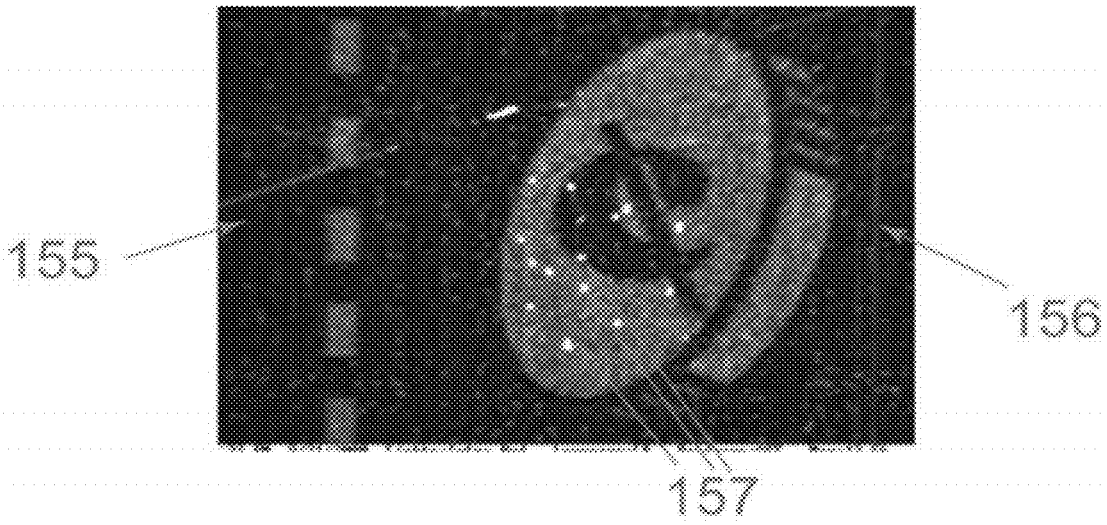
FIG. 5 is a magnified front plan view of the lottery-type instant ticket of FIG. 4 under infrared (IR) exposure detailing a microscopic pinprick attack.

For example, FIG. 4 illustrates an instant (scratch-off) type lottery ticket 150 with its SOC completely removed. On this particular game, winning variable indicia 152 will mostly include a '5' or '2' numerical character and all losing variable indicia 151 will include a numerical '1' character. As previously discussed, the relatively low resolution (240 dpi) of the variable indicia dictates that the fonts for these characters be simple and straightforward. This simplistic representation of information reduces the amount of entropy in the image and therefore makes it possible to identify particular indicia with very little visual information. To illustrate this concept, a portion of ticket 150 of FIG. 4 is magnified fourteen times over one of its scratch off spots 155 with its SOC 156 mostly intact as illustrated in FIG. 5. In FIG. 5 the illustration is also illuminated in IR light to better reveal the microscopic pinprick patterns 157 (made with a hypodermic needle) that have been placed in the SOC 156. While these pinprick holes 157 may seem random or inconsequential, the absence of any dark indicia showing through the vertical line of holes indicates that a '5' or '2' indicia is most likely not behind this SOC 156 and therefore the spot can be assumed to be associated with a loss. Conversely, if dark indicia were detected behind some of the pinprick holes, the SOC 156 would most likely be covering a winning spot. Thus, repeatable patterns of microscopic pinprick holes through apparent intact SOC can disclose enough information to deduce if indicium is a winner or loser while still allowing the SOC to appear pristine to the casual observer.

Again, these type of pinprick attacks are only possible because the relatively low resolution and monochromatic nature of existing variable indicia dictate that the symbols/text depicted by the indicia be simple and straightforward in design so that even consumers with poor eyesight can readily differentiate between indicia. Because of this simplicity in indicia design, the entropy in the scratch-off or play area is minimized. Therefore, any technique that increases the overall entropy of the scratch-off or play area while at the same time allowing individual indicia to be readily identified will greatly enhance the security of SOC protected documents from pinprick attacks. One of the most elegant methods of increasing play (scratch-off) area entropy for pinpricked documents while at the same time enhancing the readability of properly played documents with SOC removed is to increase the resolution of the indicia by a factor of two or more (e.g., 240 dpi to 600 dpi) and possibly adding color.

Figure 6:
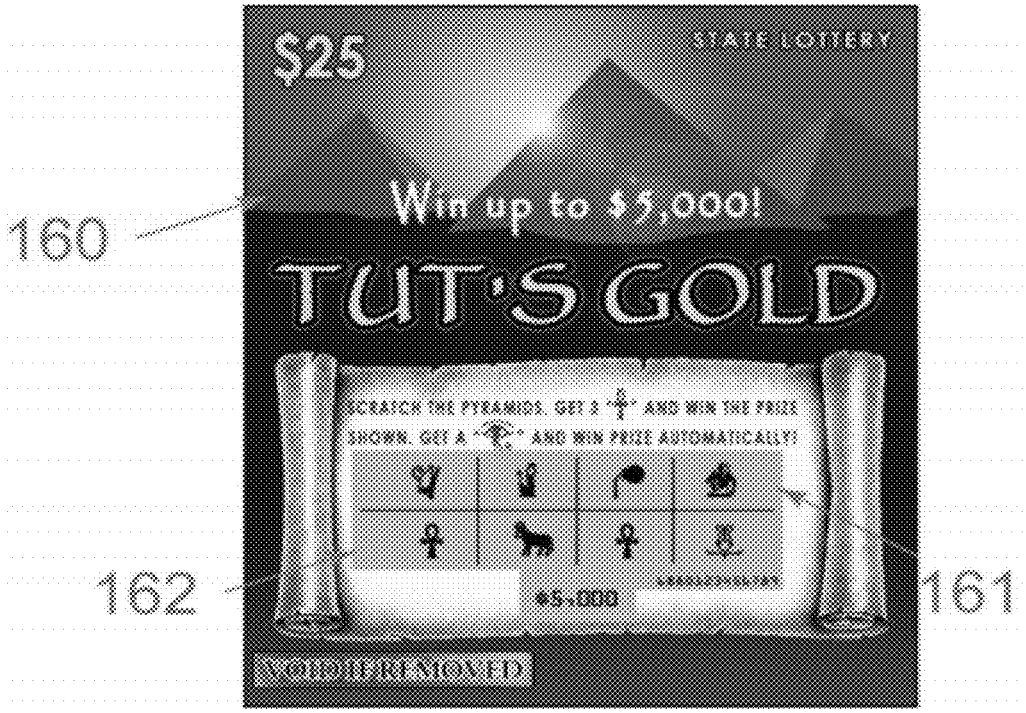
FIG. 6 is a front plan view of a second representative example of a lottery-type instant ticket susceptible to pinprick attacks.
Figure 7:
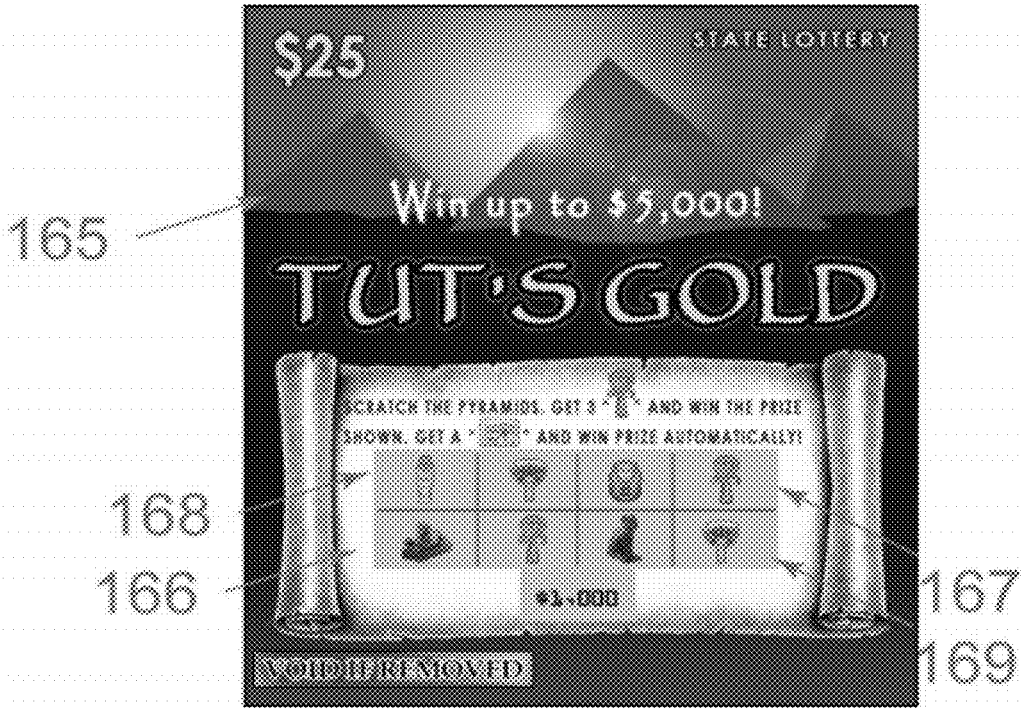
FIG. 7 is a front plan view of the second representative example of a lottery-type instant ticket of FIG. 6 modified with enhance resolution indicia and color to increase its resistance to pinprick attacks.

For example, FIG. 6 illustrates a conventional production instant lottery ticket 160 with its SOC removed revealing losing 161 and winning 162 indicia. After the previous example, it can be readily seen that a pinprick attack could be formulated to differentiate the two types of winning indicia 162 from the multiplicity of losing indicia. Traditional game design would attempt to obtain pinprick security from changing the game play dynamic from finding one or more predefined winning symbols to finding a multiplicity of the same symbol—i.e., it is much more difficult to identify all symbols via pinpricking than simply differentiating one or two winning symbols from a multiplicity of losing symbols. However, with increased indicia resolution, the game play dynamic need not be altered. FIG. 7 illustrates the same style instant lottery game 165 of FIG. 6 with higher resolution and color indicia. Notice that, while the indicia remain readily identifiable when the SOC is removed (arguably, identifiably of the indicia is enhanced in this embodiment), the entropy of information available via pinprick holes has been greatly increased. The higher resolution color indicia no longer reveal simple binary 'ink present'/'ink not present' information to a pinprick hole, rather the differing tones and coloring of the indicia of FIG. 7 provide such an abundance of information that simple pinprick patterns would almost always yield ambiguous information. While the differences between winning and losing indicia can in some cases be amplified with the added information (e.g., winning indicia 167 compared to losing indicia 166), other matches employing similar color schemes become virtually impossible to differentiate via pinprick holes (e.g., winning indicia 167 compared to losing indicia 168 or 169).

Figure 8:
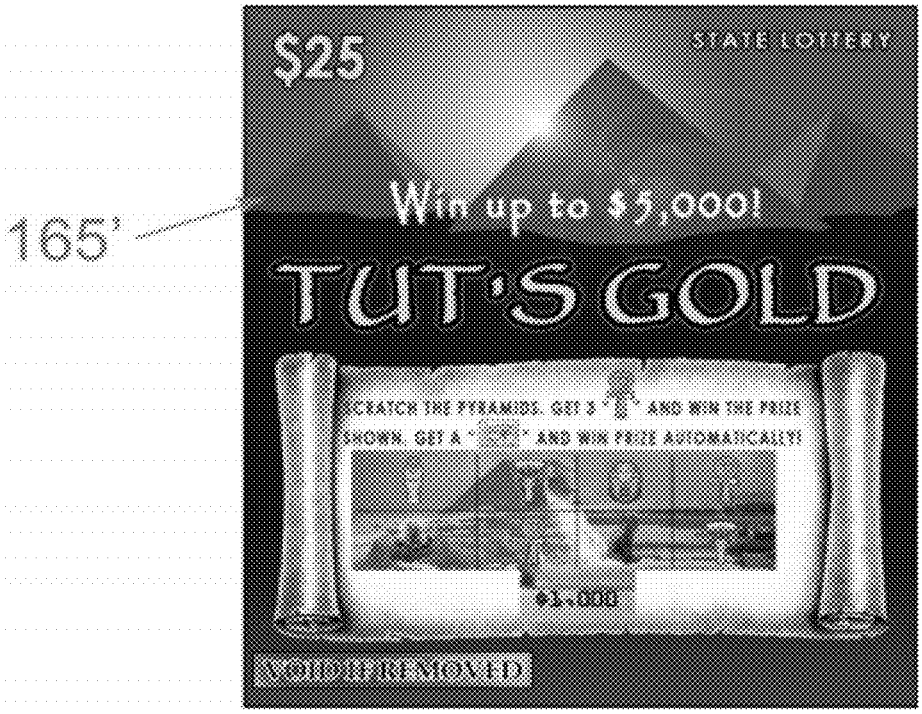
FIG. 8 is a front plan view of a second representative example of a lottery-type instant ticket of FIG. 6 with modified background using increased resolution indicia and color to further enhance its resistance to pinprick as well as cut and paste attacks.

This same concept of increasing play (scratch-off) area entropy using high resolution imaging while maintaining readily identifiable indicia on played tickets can be expanded further. FIG. 8 illustrates a modification to the embodiment of FIG. 7 wherein the ticket's 165' high resolution ink jet was also utilized to provide a background to the indicia—similar in concept to Benday patterns, but far more complex. This embodiment has the advantage of greatly increasing the entropy of the play (scratch-off) area while at the same time enhancing the ticket's appearance and correspondingly its marketability. Additionally, by adding a complex background scene (which can change from ticket to ticket), the security of the ticket or SOC document has been further enhanced to provide reliable protection against cut and paste attacks. In cut and paste attacks, consumer mortise indicia out of losing lottery tickets together to create an apparent winning ticket composite. Also typical with these attacks, the boxed digit area or SOC validation barcode area is destroyed by excessive scratching such that the ticket will no longer validate through a central site system—i.e., the boxed digit and/or validation barcode is destroyed such that a central site validation system would have insufficient information to authenticate the composite ticket. Thus, an apparent winning ticket from visual inspection can be accepted for fraudulent payment of its fabricated face value. However, with detailed variable imaged backgrounds as illustrated in FIG. 8 cut and paste attacks can be virtually eliminated.

Figure 9:
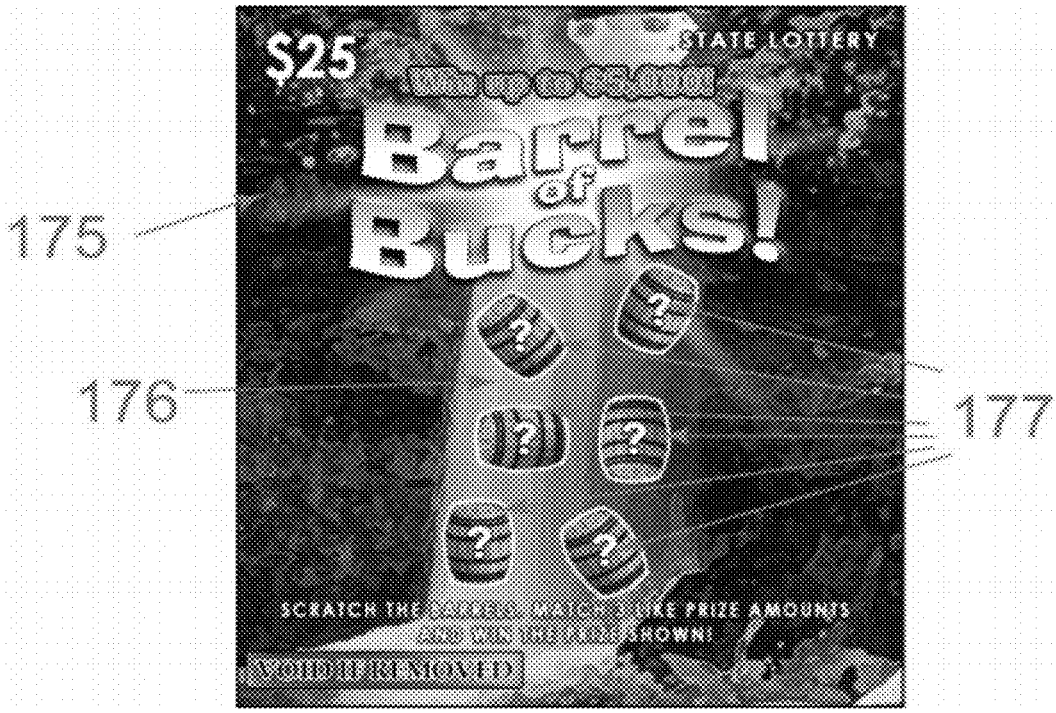
FIG. 9 is a front plan view of a third representative example of a lottery-type instant ticket with enhanced resolution indicia and color to increase its resistance to pinprick as well as cut and paste attacks by also printing decorative variable indicia background outside of the scratch-off area shown with its SOC intact.
Figure 10:
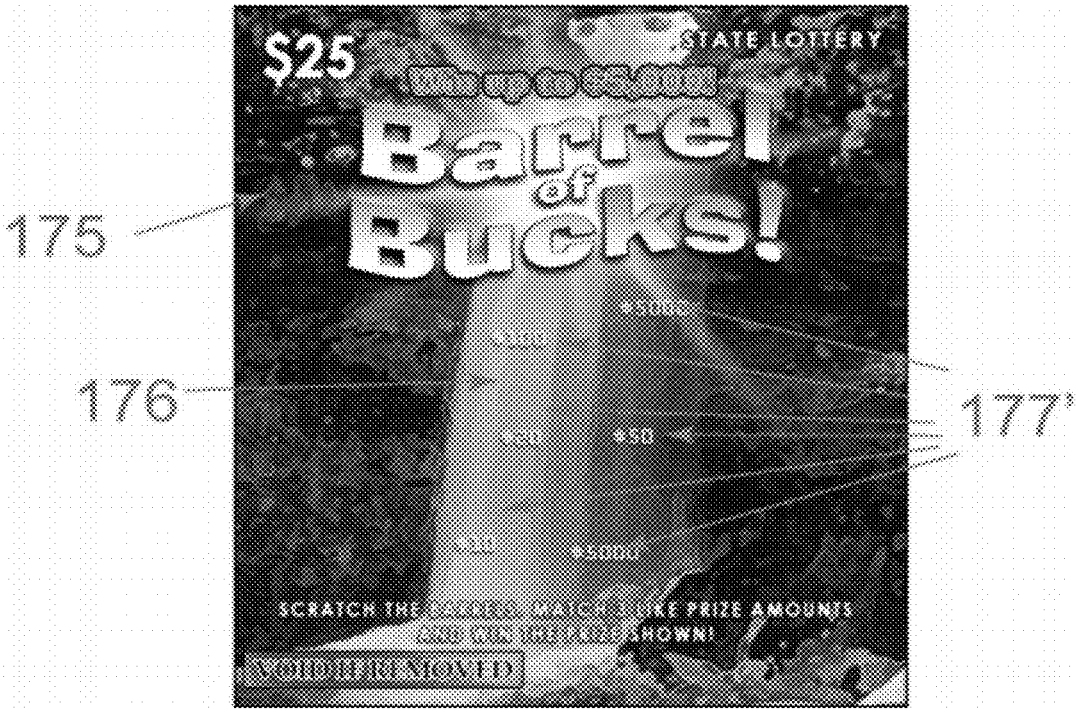
FIG. 10 is a front plan view of the third representative example of a lottery-type instant ticket of FIG. 9 with its SOC removed.

In yet another embodiment, the ink jet imaged complex background can be expanded to show portions 176 outside of the play (scratch-off) areas 177 of an unplayed (unscratched) ticket or SOC document 175—see FIG. 9. In this embodiment, the background to the indicia 176 (waterfall as illustrated in FIG. 9) is allowed to print outside of the play areas 177 (barrels as illustrated in FIG. 9) blending in with the display printed on the front of the ticket/document. This has the advantage of added security against cut and paste attacks with individual scratch-off area(s) such that the scratch-off area(s) cannot be mortised along the edges or a line to create an apparent winning composite ticket. When the SOC is removed from the ticket (FIG. 10), the background integrity is enhanced along with displaying the winning indicia 177' integrated into the variable background 176. As shown in FIG. 10, the variable background graphics can be maintained and integrated with the indicia (e.g., water splashing in front of the barrel indicia) when the SOC is removed. Assuming the background pattern is varied from ticket-to-ticket, attempting to create an apparent winning ticket via cut and paste composite from a multiplicity of losing tickets becomes exponentially more difficult as the number of patterns increases. Additionally, by varying portions (or all) of the display that is viewable before the ticket/document is played can enhance its marketability and perhaps even foster theories of lucky display configurations among consumers—e.g., if the waterfall of FIG. 10 is flowing to the left, the ticket is a winner. As is obvious to anyone skilled in the art, the variable display area(s) outside of the play area(s) can also include variable indicia that can be utilized for interactive play with the hidden indicia.

To ensure that a sufficient amount of entropy is introduced from ticket to ticket, portions of the variable background can be modulated with white noise or a Pseudo Random Number Generator (PRNG) to create continuous variability across an entire print run. For example, the waterfall background 176 of FIGS. 9 and 10 could be varied with input from a white noise filter, or a Linear Congruential Generator (LCG), or a Mersenne Twister to cause the flow of water to appear different on every ticket.

Another method of ensuring sufficient entropy is to define the indicia with the absence of any pigmented particles as illustrated in 177' of FIG. 10. In other words, rather than using the variable printing to image the game indicia itself, the high resolution variable printing (e.g., ink jet pigmented particles, ink jet dye, etc.) would only be used to print the background, thereby enabling the winning and losing indicia to be defined by the bare substrate as illustrated in 177' of FIG. 10. By defining the winning/losing indicia with the absence of imaging, pin prick attacks become virtually impossible because bare substrate exposed by the small areas exposed by the pin prick holes could be indicia or could simply be bare areas in the background art work—e.g., white areas of the water fall 176 of FIG. 10.

Figure 11:
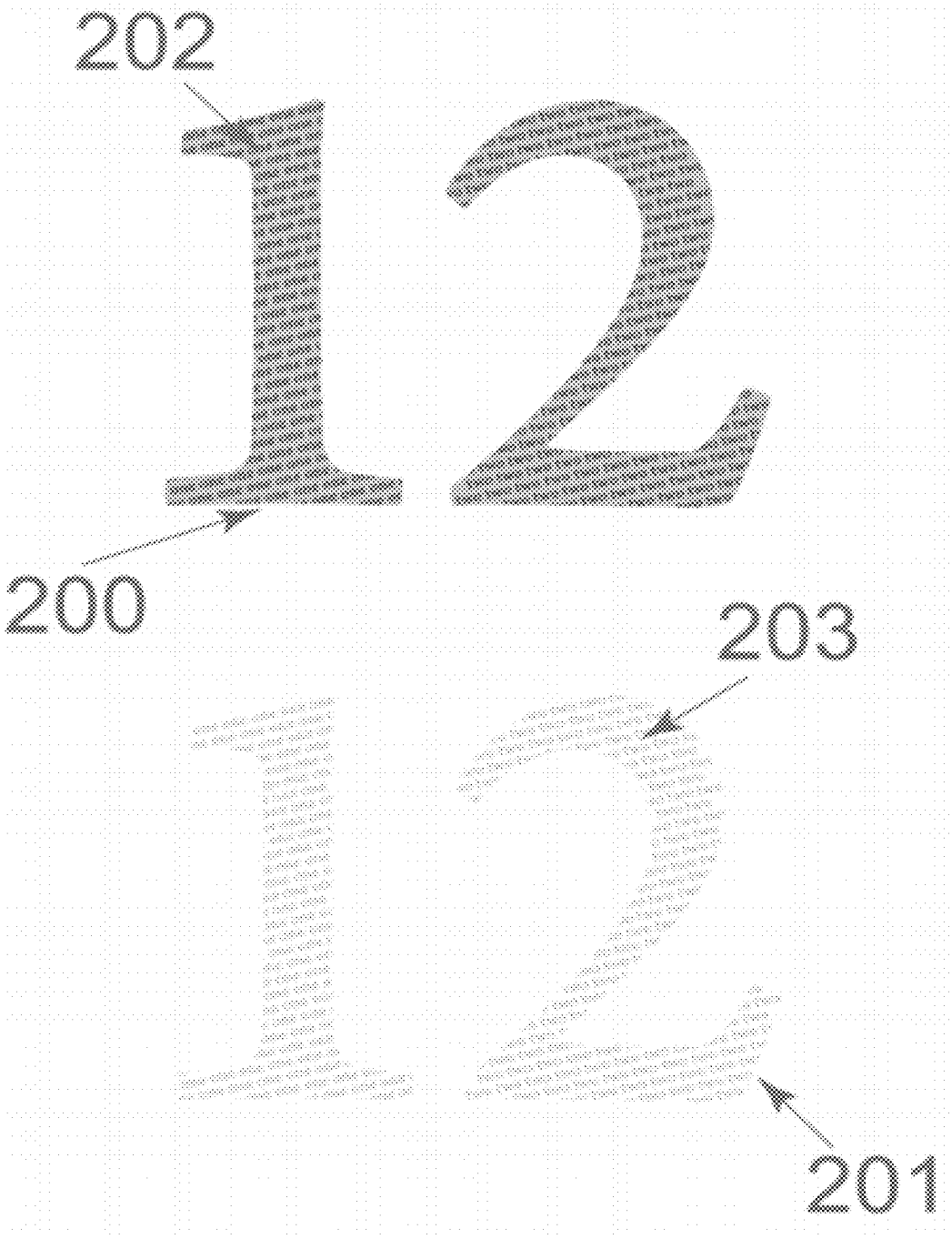
FIG. 11 is a view of a high resolution monochromatic images incorporating embedded micro-characters.

From the previous examples, it should not be deduced that higher resolution indicia as well as imaged backgrounds require color imaging to ensure sufficient entropy. Indeed, monochromatic high-resolution imagers can be utilized to the same effect and may be preferable in cases where printing press costs are an issue. For example, FIG. 11 illustrates two versions of the indicia '12' both printed with high-resolution monochromatic imagers. Indicia 200 illustrate the number '12' outlined in a gray background (i.e., halftone) with micro printing 202 spelling out the name of each number—i.e., 'one' and 'two'. In contrast, indicia 201 incorporate no halftone background with the indicia '12' being defined only with the micro printing 203 of the number's names. This type of named micro printing can be used to help thwart forgeries and resolve conflicts that may arise in lottery ticket visual redemption. However, the higher contrast required for clarity of micro printing is difficult to achieve with color indicia, particular the gray background of indicia 200. In both of these examples entropy would be enhanced against attacks while at the same time enhancing readability of a properly played SOC secure document. This is possible because the small holes necessitated by pinprick attacks do not allow sufficient area to identify a micro printed name. At the same time the variability of tone in the micro printed indicia area decreases the probability of obtaining useful information per pin prick hole—e.g., there is approximately 50%/50% area distribution of micro printing and bare white space in the indicia of 201.

Finally, higher resolution indicia would also enable smaller validation barcodes to be printed under the SOC, which would have the advantages of higher security because the barcode could be floated around the scratch-off area more freely from ticket-to-ticket as well as providing a validation barcode that decodes more readily.

What is claimed is:

1. A security-enhanced document, comprising:

a bare, white substrate defining a bottom-most layer of the security-enhanced document;

indicia provided directly on said bare, white substrate, said indicia comprising pigmented nanoparticles in process color applied directly to said white substrate without an intervening layer in a printing process to form pigmented-particle indicia, said pigmented nanoparticles having a size of between 1 nanometer and less than 100 nanometers;

a Scratch-Off-Coating (SOC) layer applied over said indicia to maintain said indicia unreadable until removal of said SOC, wherein said SOC layer comprises at least one opacity ink film, said at least one opacity ink film comprising a nanoparticles sized pigment film having pigmented nanoparticles with a size of between 1 nanometer and less than 100 nanometers; wherein said pigmented-particle indicia has a resolution of at least 500 dpi; and further comprising a background surrounding said pigmented-particle indicia that is also covered by said SOC layer, the background varying between at least one of color or pattern throughout said SOC layer area to form a varying background, wherein said background and said pigmented-particle indicia are printed simultaneously under computer control.

2. The document as in claim 1, wherein said opacity ink film layer is a metal-based film layer with metal pigmented nanoparticles.

3. The document as in claim 2, further comprising a white pigment source applied over said opacity ink film layer.

4. The document as in claim 1, further comprising at least one opacity ink film layer applied on said substrate below said pigmented-particle indicia such that the substrate is free of indicia printed directly thereon.

5. The document as in claim 1, wherein said pigmented-particle indicia is non-metallic.

6. The document as in claim 1, wherein said pigmented-particle indicia is a security barcode.

7. The document as in claim 1, wherein said varying background cooperates with forming indicia or graphics on said document outside of said SOC layer area.

8. The document as in claim 1, wherein said document is an instant lottery ticket.

* * * * *